US011624209B2

(12) United States Patent
Dirnberger et al.

(10) Patent No.: US 11,624,209 B2
(45) Date of Patent: Apr. 11, 2023

(54) DOOR LOCK FOR A DOMESTIC ELECTRICAL APPLIANCE

(71) Applicant: emz-Hanauer GmbH & Co. KGaA, Nabburg (DE)

(72) Inventors: Albert Dirnberger, Neunburg vorm Wald (DE); Georg Spiessl, Altendorf (DE); Markus Lang, Neunburg vorm Wald (DE); Robert Reitinger, Lappersdorf (DE)

(73) Assignee: EMZ HANAUER GMBH & CO. KGAA, Nabburg (DE)

( * ) Notice: Subject to any disclaimer, the term of this patent is extended or adjusted under 35 U.S.C. 154(b) by 321 days.

(21) Appl. No.: 16/868,598

(22) Filed: May 7, 2020

(65) Prior Publication Data

US 2020/0354993 A1 Nov. 12, 2020

Related U.S. Application Data

(60) Provisional application No. 62/845,929, filed on May 10, 2019.

(30) Foreign Application Priority Data

Aug. 6, 2019 (DE) ..... 10 2019 005 564.0

(51) Int. Cl.
*E05B 63/18* (2006.01)
*E05B 17/22* (2006.01)
(Continued)

(52) U.S. Cl.
CPC ..... *E05B 63/185* (2013.01); *E05B 9/02* (2013.01); *E05B 17/2007* (2013.01);
(Continued)

(58) Field of Classification Search
CPC ..... Y10T 292/1014; Y10T 292/1021; Y10T 292/68; Y10T 292/696; Y10T 292/699;
(Continued)

(56) References Cited

U.S. PATENT DOCUMENTS 780,192 A 1/1905 Jones
2,772,106 A 11/1956 Semelka
(Continued)

FOREIGN PATENT DOCUMENTS

CN 101666028 A 3/2010
CN 104099753 A * 10/2014 ..... D06F 37/42
(Continued)

*Primary Examiner* — Christine M Mills
*Assistant Examiner* — Steven A Tullia
(74) *Attorney, Agent, or Firm* — Hayes Soloway PC

(57) ABSTRACT

A door lock for a domestic electrical appliance includes a locking member which is electrically switchable between an unlocking position and a locking position, which locking member in the unlocking position allows a closed door of the domestic appliance to be opened and in the locking position is in blocking engagement with a blockable component at least when the door is closed, and an auxiliary member, separate from the blockable component, which is movable in dependence on the closing of the door from a release position into a blocking position. The blocking engagement effects blocking of the closed door against opening. In the release position, the auxiliary member allows the locking member to be transferred from the unlocking position into the locking position; in contrast, in its blocking position, the auxiliary member blocks the locking member against being transferred from the unlocking position into the locking position.

12 Claims, 11 Drawing Sheets

(51) Int. Cl.

| | |
|---|---|
| ***E05B 47/00*** | (2006.01) |
| ***E05B 47/06*** | (2006.01) |
| ***E05B 9/02*** | (2006.01) |
| ***E05B 17/20*** | (2006.01) |
| ***E05C 19/00*** | (2006.01) |
| ***E05B 63/00*** | (2006.01) |
| ***D06F 39/14*** | (2006.01) |
| ***D06F 58/20*** | (2006.01) |

(52) U.S. Cl.
CPC ..... *E05B 17/22* (2013.01); *E05B 47/0001* (2013.01); *E05B 47/0004* (2013.01); *E05B 47/0046* (2013.01); *E05B 47/0603* (2013.01); *E05B 63/0056* (2013.01); *E05C 19/009* (2013.01); *D06F 39/14* (2013.01); *D06F 58/20* (2013.01); *E05B 2047/0068* (2013.01); *E05B 2047/0069* (2013.01); *E05B 2047/0092* (2013.01); *E05Y 2900/312* (2013.01)

(58) Field of Classification Search
CPC .... E05B 63/185; E05B 17/22; E05B 47/0004; E05B 47/0001; E05B 47/0603; E05B 9/02; E05B 17/2007; E05B 2047/0068; E05B 2047/0069; E05B 2047/0092; E05B 63/18; E05B 63/20; E05B 63/202; E05B 17/20; E05B 17/2007; E05B 17/203; E05B 17/2034; E05B 17/2042; E05B 17/2084; E05B 17/2088; E05B 47/00; E05B 47/0002; E05B 47/0003; E05B 47/0046; E05B 47/02; E05B 47/026; E05B 47/06; E05B 47/0607; E05B 2047/0014; E05B 2047/0015; E05B 2047/0016; E05B 2047/0024; E05B 2047/0025; E05B 2047/0036; E05B 2047/0067; D06F 39/14; D06F 58/20; D06F 37/42; E05C 19/009; E05Y 2900/312; Y10S 292/04; Y10S 292/65; Y10S 292/69
See application file for complete search history.

(56) References Cited

U.S. PATENT DOCUMENTS

| | | | | |
|---|---|---|---|---|
| 2,837,361 | A | 6/1958 | Loeb | |
| 2,857,191 | A | 10/1958 | Buchholtz | |
| 3,260,813 | A | 7/1966 | Dargene | |
| 3,765,194 | A | 10/1973 | Moore | |
| 4,351,288 | A | 9/1982 | Gasloli | |
| 4,907,831 | A | 3/1990 | Di Giusto | |
| 4,932,707 | A * | 6/1990 | Ekstran | D06F 37/42 292/108 |
| 5,004,276 | A * | 4/1991 | Hanley | E05C 19/022 292/201 |
| 5,062,668 | A | 11/1991 | Onderka et al. | |
| 5,176,417 | A | 1/1993 | Bauer | |
| 5,419,305 | A | 5/1995 | Hanley | |
| 5,494,325 | A | 2/1996 | Liu et al. | |
| 5,997,056 | A | 12/1999 | Yamagishi | |
| 6,155,616 | A | 12/2000 | Akright | |
| 6,279,972 | B1 | 8/2001 | Brill et al. | |
| 6,290,270 | B1 | 9/2001 | Spiessl | |
| 6,390,518 | B1 | 5/2002 | Elick | |
| 6,739,633 | B2 | 5/2004 | Holloway et al. | |
| 6,913,296 | B2 | 7/2005 | Bassi | |
| 7,032,939 | B2 | 4/2006 | Magnusson | |
| 7,210,711 | B2 | 5/2007 | Dirnberger et al. | |
| 7,299,666 | B2 | 11/2007 | Geyer et al. | |
| 7,299,809 | B2 | 11/2007 | Kang | |
| 8,736,406 | B2 | 5/2014 | Hapke et al. | |
| 8,991,877 | B2 | 3/2015 | Spiessl | |
| 2002/0056997 | A1 | 5/2002 | Bassi | |
| 2003/0160461 | A1 | 8/2003 | Promutico | |
| 2005/0194795 | A1 | 9/2005 | Hapke et al. | |
| 2006/0101869 | A1 | 5/2006 | Osvatic | |
| 2008/0042447 | A1 | 2/2008 | Neumann | |
| 2011/0057460 | A1 | 3/2011 | Onofrio | |
| 2014/0103788 | A1* | 4/2014 | Park | D06F 39/14 312/237 |
| 2016/0138809 | A1 | 5/2016 | Colucci et al. | |
| 2016/0222573 | A1* | 8/2016 | Dirnberger | D06F 39/14 |
| 2016/0251881 | A1 | 9/2016 | Dirnberger et al. | |
| 2016/0356057 | A1* | 12/2016 | Lin | E05C 19/10 |
| 2016/0376742 | A1* | 12/2016 | McDonald | D06F 39/14 8/137 |
| 2017/0067270 | A1* | 3/2017 | Lang | E05B 65/00 |
| 2017/0145613 | A1* | 5/2017 | Choi | E05C 19/022 |
| 2017/0211221 | A1* | 7/2017 | Uros | D06F 39/14 |
| 2018/0008120 | A1* | 1/2018 | Dirnberger | E05C 3/24 |
| 2018/0371800 | A1 | 12/2018 | McDonald et al. | |

FOREIGN PATENT DOCUMENTS

| | | | | | |
|---|---|---|---|---|---|
| CN | 108070990 | A * | 5/2018 | | D06F 37/42 |
| DE | 3426738 | A1 | 1/1986 | | |
| DE | 3919458 | A1 | 12/1990 | | |
| DE | 19601230 | A1 | 7/1997 | | |
| DE | 19837248 | A1 | 2/2000 | | |
| DE | 102004060607 | B3 | 3/2006 | | |
| DE | 102007025295 | A1 | 12/2007 | | |
| DE | 102006058322 | A1 | 6/2008 | | |
| DE | 102006037494 | B4 | 7/2008 | | |
| DE | 102008009271 | B3 * | 9/2009 | | A47L 15/4259 |
| DE | 102007033451 | B4 | 9/2011 | | |
| DE | 10 2010 051 518 | A1 | 5/2012 | | |
| DE | 202015100627 | U1 | 6/2015 | | |
| DE | 102015002538 | B3 | 3/2016 | | |
| DE | 102017006649 | B3 * | 9/2018 | | D06F 37/28 |
| EP | 1344486 | A2 | 9/2003 | | |
| EP | 1975300 | A1 * | 10/2008 | | A47L 15/4259 |
| EP | 1460163 | B1 | 1/2009 | | |
| EP | 1 544 387 | B1 | 12/2010 | | |
| EP | 2369050 | A2 * | 9/2011 | | A47L 15/4259 |
| EP | 2 367 997 | B1 | 5/2013 | | |
| EP | 1 975 300 | B1 | 8/2015 | | |
| EP | 3037579 | A1 * | 6/2016 | | D06F 37/42 |
| EP | 3119936 | B1 * | 5/2018 | | A47L 15/4259 |
| GB | 2317002 | A * | 3/1998 | | D06F 58/04 |
| JP | 2008-274741 | A | 11/2008 | | |
| KR | 100813045 | B1 * | 4/2002 | | D06F 39/14 |
| KR | 20100125071 | A * | 5/2009 | | D06F 37/42 |
| KR | 20110035034 | A * | 9/2009 | | D06F 39/14 |
| KR | 20120127020 | A * | 5/2011 | | D06F 33/00 |
| KR | 101370293 | B1 * | 11/2012 | | A47L 15/4259 |
| KR | 20140064420 | A | 5/2014 | | |
| KR | 20140101129 | A | 8/2014 | | |
| PL | 361358 | A | 10/2004 | | |
| WO | 02/34994 | A1 | 5/2002 | | |
| WO | 2006/063684 | A1 | 6/2006 | | |
| WO | 2011109235 | A1 | 9/2011 | | |
| WO | 2011132213 | A1 | 10/2011 | | |
| WO | 2013109585 | A2 | 7/2013 | | |
| WO | 2013/150410 | A1 | 10/2013 | | |
| WO | WO-2013181289 | A9 * | 1/2014 | | D06F 37/42 |
| WO | WO-2014058714 | A2 * | 4/2014 | | D06F 37/42 |
| WO | 2018236746 | A1 | 12/2018 | | |

* cited by examiner

DOOR LOCK FOR A DOMESTIC ELECTRICAL APPLIANCE

BACKGROUND OF THE INVENTION

1. Field of the Invention

The present invention relates generally to a door lock for a domestic electrical appliance. In particular, the present invention is concerned with measures for avoiding manipulations which can lead to unauthorized or undesirable operating states of the domestic electrical appliance equipped with the door lock.

2. Description of the Prior Art

Conventional door locks for domestic washing machines, for example, are equipped with a locking mechanism which comprises an electromagnetically or electromotively actuatable locking element which, after the door of the washing machine has been closed, can be moved from an unlocking position into a locking position. In the unlocking position of the locking element, the door, after it has been closed, can be opened again by the user without difficulty. In the locking position of the locking element, on the other hand, the door is locked, that is to say it cannot be opened without force. In conventional domestic washing machines, locking of the door is a requirement for washing operation of the washing machine; unless the door has been locked beforehand, there is no supply of water to the washing chamber of the washing machine. The actuator (electromagnet, electric motor) provided for actuating the locking element is in turn activated in conventional domestic washing machines in dependence on the detection of the closed state of the door. Conventional door locks comprise for this purpose an electrical switch which is closed on closing of the door and thereby closes an electrical supply path to the actuator. Current can then be fed to the actuator via the supply path, which is now closed, for the purpose of actuating the locking element.

Some conventional door locks for domestic washing machines have a reed switch for detecting the closed door state. The reed switch is controlled by a magnet, which moves closer to the reed switch on closing of the door and finally leads to a change in the switching status of the reed switch.

Magnets are frequently found in a private household, for example for hanging photographs, memos or other documents on a metal surface. The possibility cannot be ruled out that a user will inadvertently or deliberately move into the vicinity of the reed switch of a washing machine door lock with such a magnet and thereby intentionally or unintentionally cause a locking element of the door lock to be transferred into its locking position without the door of the washing machine previously having been closed. This can have the dangerous consequence that the washing machine starts an operating cycle with the door open.

SUMMARY OF THE INVENTION

An object of the present invention is to provide a door lock for a domestic electrical appliance which offers a high degree of protection against deliberate or inadvertent manipulation of the lock. In particular, it is an object of the present invention to provide a door lock having a locking function which offers a high degree of security against intentional or unintentional manipulation.

In order to achieve this object there is provided according to a first aspect a door lock for a domestic electrical appliance, wherein the door lock comprises: a locking member which is electrically switchable between an unlocking position and a locking position, which locking member in the unlocking position allows a closed door of the domestic appliance to be opened and in the locking position is in blocking engagement with a blockable component at least when the door is closed, wherein the blocking engagement effects blocking of the closed door against opening; and an auxiliary member, separate from the blockable component, which is movable in dependence on the closing of the door from a blocking position into a release position and which in the release position allows the locking member to be transferred from the unlocking position into the locking position and in the blocking position blocks the locking member against being transferred from the unlocking position into the locking position.

The invention can be used in domestic appliances of different types. These include washing machines, tumble dryers, so-called washer-dryers (that is to say appliances which offer a combined washing and drying function for laundry), ovens, microwave ovens and the like.

In the solution according to the invention, the locking member is blocked in its unlocking position by the auxiliary member as long as the door of the domestic appliance is not closed. Blocking of the locking member by the auxiliary member prevents the locking member from being transferred from the unlocking position into the locking position. It is entirely possible that the locking member—even when it is blocked by the blocking member—has a certain degree of play starting from the unlocking position in the direction towards the locking position. In any case, however, the blocking of the locking member by the auxiliary member prevents a change of position of the locking member into the locking position. Even if a user, in a situation in which the door of the domestic appliance is open and the locking member is blocked in its unlocking position by the auxiliary member, closes an electrical door switch by inadvertent or deliberate manipulation and this is interpreted by an electrical control unit of the domestic appliance as being the triggering signal for the feed of current to an actuator for the locking member, the locking member would nevertheless not be able to move into its locking position because it is blocked by the auxiliary member. Transfer of the locking element into the locking position is possible only when the auxiliary member has previously been moved into its release position. In the described situation of a manipulation of an electrical door switch when the door is still open, the user would additionally have to actively move the auxiliary member out of the blocking position into the release position, for example by means of a screwdriver or other pin-like object; the user would thus effectively have to perform a two-fold manipulation, which is unlikely and in any case would be difficult for the user to accomplish.

If, on the other hand, the door is closed properly, the locking member—because it is no longer blocked by the auxiliary member—can be transferred unhindered from its unlocking position into the locking position and the closed door can thereby be locked.

In the solution according to the invention, the auxiliary member is a component that is separate from and independent of the blockable component. The blockable component is the component that is blocked by the locking member when the locking member reaches its locking position. The auxiliary member, on the other hand, is a component that serves to block the locking member. Overall, the basic concept of the solution according to the invention therefore starts from three separate components, the locking member, the auxiliary member and the blockable component.

In some embodiments, the auxiliary member is controlled by a closing element which, on closing of the door, comes into physical control contact with the auxiliary member and urges the auxiliary member into its release position. The closing element is, for example, an element that, on closing of the door, enters an insertion opening of a lock assembly containing the locking member and the auxiliary member and thereby strikes the auxiliary member and urges it out of the blocking position into the release position. If the auxiliary member is biased into its blocking position by a spring element, the auxiliary member can be urged by the force of the spring element back into the blocking position when the door is opened, that is to say when the closing element is withdrawn from the insertion opening of the lock assembly again.

In some embodiments, the door lock comprises an electrical switch controlled by the closing element, which electrical switch, on closing of the door, undergoes a change of switching status under the control of the closing element. The change of switching status, which is, for example, a change from an open switch status to a closed switch status, can be interpreted by an electrical control unit of the domestic appliance as a signal that the door is closed. The electrical switch can therefore serve as a detection element for detecting closing of the door.

In some embodiments, the electrical switch is magnetically actuatable and can be caused to change switching status on closing of the door by a magnet arranged on the closing element. For example, the electrical switch can be formed by a reed switch which changes from one switching status to another switching status when the closing element is sufficiently close and there is thus a sufficient increase in the magnetic field generated by the magnet and acting on the reed switch. In other embodiments, on the other hand, there is provided a movably guided component (e.g. in the form of a linear slider) which carries one of two switch contacts of the electrical switch or is coupled for movement with such a switch contact and, on closing of the door, is urged by the closing element out of a first position into a second position. In the first position, the two switch contacts are apart, for example, while in the second position they lie against one another. The displacement of the movably guided component out of the first position into the second position can be effected by the closing element, for example, again by means of magnetic force or alternatively by physical contact.

In some embodiments, the closing element forms the blockable component. When the door is locked, the locking member in these embodiments is directly in locking engagement with the closing element.

For actuation of the locking member, that is to say for moving the locking member between the unlocking position and the locking position, the door lock in some embodiments comprises an electromagnetic actuator and also a guide system which serves to control the position of the locking member. The guide system has an endless guide track which is closed to form a loop, and a track follower guided on the guide track. On successive actuations of the electromagnetic actuator, the track follower performs a complete circuit along the guide track, wherein, on each circuit, the track follower moves out of a first non-transitory track position corresponding to the unlocking position of the locking member into a second non-transitory track position corresponding to the locking position of the locking member and back into the first non-transitory position again. A non-transitory track position means a position that the track follower can assume permanently in a non-excited state of the electromagnetic actuator. The configuration of the guide track as an endless track closed in the manner of a loop is suitable for a pulsed actuation of the electromagnetic actuator. In the case of such an operation of the electromagnetic actuator, a comparatively brief current feed pulse is sufficient to move the track follower out of one of the non-transitory track positions (for example against a restoring spring force) and into a transitory position along the guide track from which the track follower is able to move automatically, for example under the action of the mentioned spring force, into another of the non-transitory track positions once the current feed to the electromagnetic actuator has ended. The track follower remains in this other non-transitory track position until a further pulse actuation of the electromagnetic actuator brings the track follower into a new non-transitory track position again.

In embodiments having an electromagnetic actuator and a track follower guided on an endless guide track, different variants are conceivable for achieving blocking of the locking member by the auxiliary member. In some embodiments, the auxiliary member has a blocking structure which, in the blocking position of the auxiliary member, extends into the movement path of the track follower along the guide track in such a manner that the blocking structure prevents a change of the track follower from the first non-transitory position into the second non-transitory position. When the auxiliary member is transferred from the blocking position into the release position, the blocking structure moves out of the movement path of the track follower along the guide track in such a manner that a change of the track follower from the first non-transitory track position into the second non-transitory track position is made possible.

For example, in the blocking position of the auxiliary member, the blocking structure extends into the movement path of the track follower along the guide track in such a manner that, on actuation of the electromagnetic actuator, the track follower remains within a track branch of the guide track adjoining the first non-transitory track position which, when actuation of the electromagnetic actuator is ended, ensures or makes it possible that the track follower falls back into the first non-transitory track position.

In other embodiments, the auxiliary member in its blocking position extends into the movement path of the locking member in such a manner that the locking member is prevented from being transferred from the unlocking position into the locking position by abutment of the locking member on the auxiliary member.

In some embodiments, the auxiliary member is linearly movable between its release position and its blocking position.

In some embodiments, the locking member is linearly movable parallel (for example parallel in the same direction) or perpendicularly to the movement direction of the auxiliary member.

According to a further aspect, the present invention provides a domestic electrical appliance which comprises an appliance main body having an access opening to a working chamber within the appliance main body and also a door attached to the appliance main body for closing the access opening. The domestic appliance further comprises a door lock having a lock assembly and a closing element. The lock assembly is attached either to the appliance main body or to the door and has an insertion opening. The closing element is attached to the other of the appliance main body and the door and, on closing of the door, enters the insertion opening of the lock assembly. The lock assembly comprises a locking member which can be electrically switched between an unlocking position and a locking position and which in the unlocking position allows the closed door to be opened and in the locking position is in blocking engagement with a blockable component of the door lock at least when the door is closed. The blocking engagement effects blocking of the closed door against opening. The lock assembly further comprises an auxiliary member, separate from the blockable component, which is movable in dependence on the closing of the door from a blocking position into a release position and which in the release position allows the locking member to be transferred from the unlocking position into the locking position and in the blocking position blocks the locking member against being transferred from the unlocking position into the locking position.

For example, the domestic appliance is a washing machine of the top loader type, that is to say a washing machine whose laundry access opening is located on the upper side of the appliance main body. Other types of domestic appliance are of course not excluded as a field of application of the invention.

In some embodiments, the locking member is linearly movable in a direction that extends at least approximately perpendicularly to a direction in which the closing element enters the insertion opening on closing of the door.

The invention will be explained further hereinbelow with reference to the accompanying drawings.

DETAILED DESCRIPTION OF THE INVENTION

Figure 1:
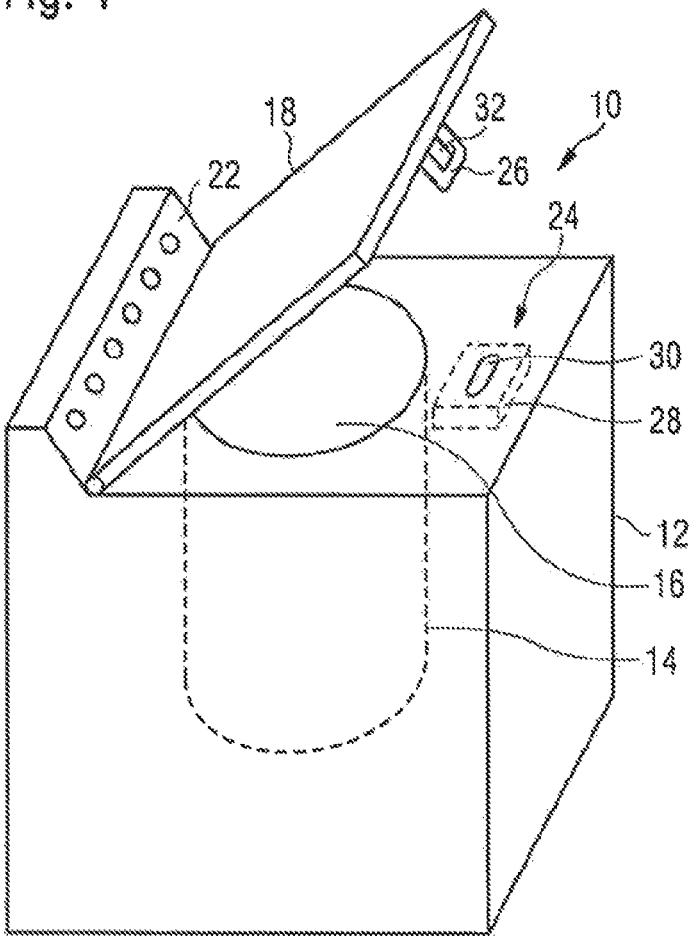
FIG. 1 is a perspective view, in schematic form, of a domestic washing machine according to an exemplary embodiment.

Reference will first be made to FIG. 1. The domestic washing machine shown therein, designated generally 10, is of the top loader type in the example shown and comprises a machine main body 12 in which a liquor container 14, shown by broken lines, is accommodated. In the liquor container 14, a wash drum (not shown) is rotatably mounted in a manner known per se, which wash drum forms a working chamber (wash chamber) of the washing machine 10. This wash chamber is accessible through an access opening 16 formed on the upper side of the machine main body 12. A lid 18 mounted on the machine main body 12 to be pivotable about a horizontal pivot axis can be pivoted upwards in order to free the access opening 16 and allow the user to insert and remove laundry, and folded downwards so that the lid 18 lies horizontally on the machine main body 12 and blocks the access opening 16. On an operating panel 20 there are various operating elements and display elements which serve for the user as a control interface of the washing machine and allow the user to set different wash programs, for example.

The lid 18 forms a door within the meaning of the present disclosure. It will be appreciated that the invention is not limited to washing machines of the top loader type; instead, it can equally be used, for example, in domestic washing machines of the front loader type, which conventionally have a bull's eye door which is pivotable about a vertical pivot axis. Hereinbelow, the lid 18 will nevertheless continue to be referred to as a lid (and not as a door).

For holding the lid 18 closed, that is to say when it has been folded down onto the machine main body 12, there serves a door lock, designated generally 24, which comprises as two fundamental components a closing element 26 and a lock assembly 28. The closing element 26 and the lock assembly 28 cooperate on closing of the lid 18 in that the closing element 26 enters an insertion opening 30 of the lock assembly 28 and can be secured by the lock assembly 28 against being lifted out of the insertion opening 30, in a manner which will be explained in greater detail hereinbelow. In the example shown, the closing element 26 is mounted on the lid 18, while the lock assembly 28 is attached to the machine main body 12. It will be appreciated that the pattern of arrangement of the closing element 26 and the lock assembly 28 can be reversed, that is to say the closing element 26 can be mounted on the machine main body 12 and the lock assembly 28 can be attached to the lid 18.

The closing element 26 has a recess 32 into which a locking member (not shown separately in FIG. 1) contained in the lock assembly 28 can engage for the purpose of locking the lid 18. As long as the locking member is not engaged in the recess 32 of the closing element 26, the lid 18 can be opened again by the user at any time. The start of a wash program, in particular the admission of water into the liquor container 14, is only possible in the case of the washing machine 10 once the locking member has engaged in the recess 32 of the closing element 26 and the lid 18 is accordingly locked.

Figure 2:
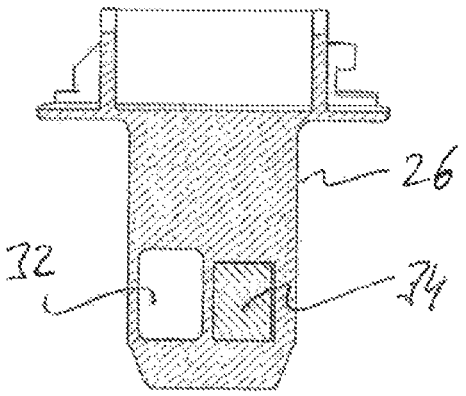
FIG. 2 is a section through a closing element according to an exemplary embodiment.

Reference will now additionally be made to FIG. 2. The closing element 26 shown therein has, in addition to the recess 32, a permanent magnet 34 which is permanently installed in the closing element 26 and serves to control a reed switch of the lock assembly 28 which will be discussed hereinbelow.

Figure 3A:
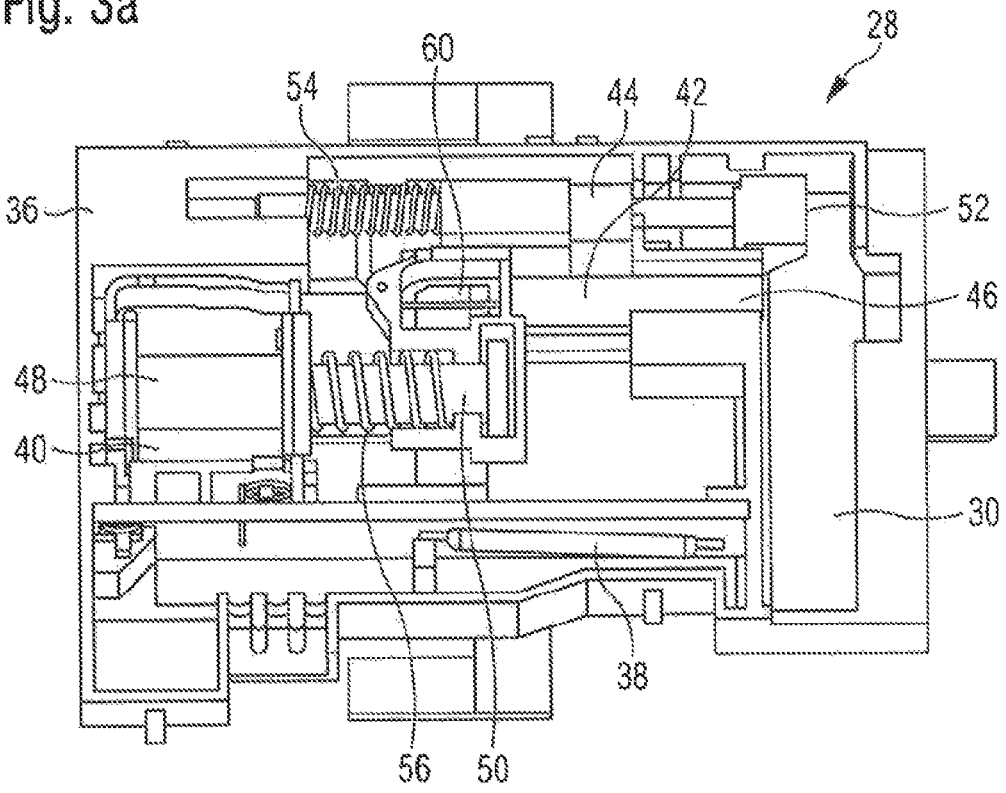
FIG. 3*a* shows a lock assembly of a door lock according to an exemplary embodiment.
Figure 3B:
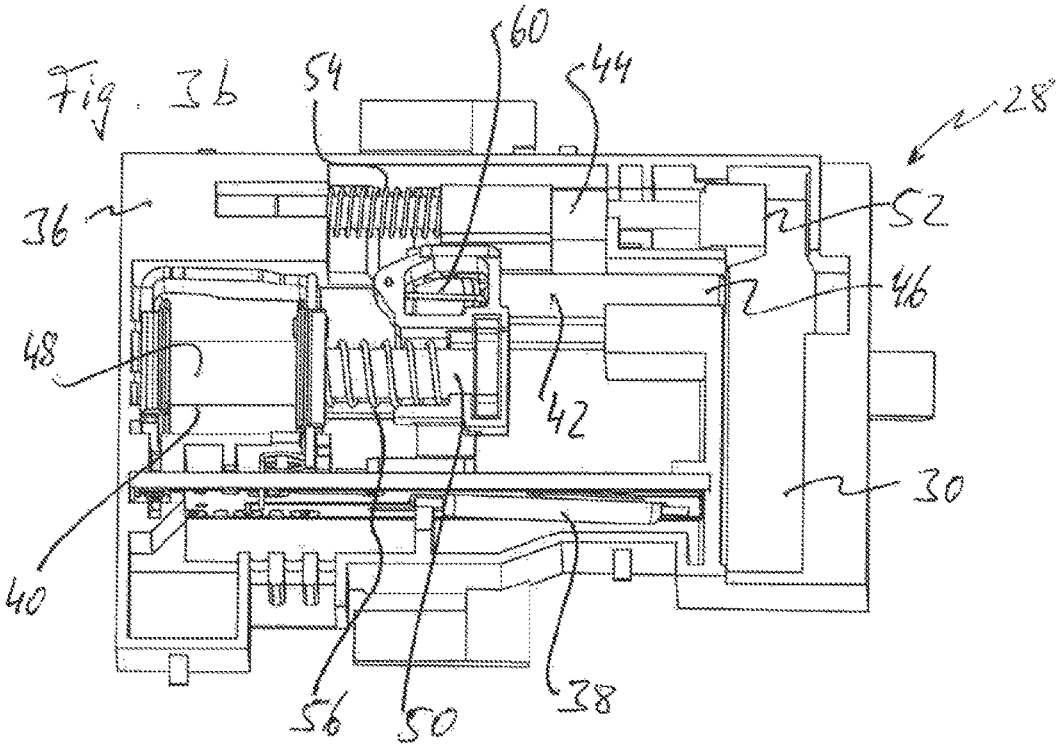
FIG. 3*b* shows the lock assembly of FIG. 3*a* as a line drawing.

Reference will now additionally be made to the exemplary embodiment of the lock assembly 28 according to FIGS. 3*a*, 3*b*. The lock assembly 28 comprises a lock housing 36 in which an electrical door switch 38, an electromagnetic actuator 40, a locking member 42 (hereinafter also referred to as locking slider) and an auxiliary member 44 (hereinafter also referred to as auxiliary slider) are received. The door switch 38 responds to closing of the lid 18 and, by its switching status, signals to an electrical control unit, not shown in greater detail, of the washing machine 10 whether the lid 18 is closed or not. The door switch 38 is formed by a reed switch and is controlled by the magnet 34 of the closing element 26. On closing of the lid 18, the magnet 34 enters the insertion opening 30 of the lock assembly 28, whereby the reed switch 38 enters the magnetic field of the magnet 34. The influence of the magnetic field of the magnet 34 effects a change in the switching status of the reed switch 38.

The locking member 42 is in the form of a linear slider which is movably guided in the lock housing 36 in a linear sliding direction. The sliding direction of the locking slider 42 is approximately perpendicular to the direction in which the closing element 26 enters the insertion opening 30 on closing of the lid 18. Although the closing element 30 follows a circular path on closing of the lid 18, at the point at which the closing element 26 enters the lock assembly 28 the associated track portion of the circular path can be understood in good approximation as being a straight line, wherein this straight line is oriented substantially perpendicularly to the sliding direction of the locking slider 42. The locking slider 42 has a leading locking tip 46 which is intended to engage in the recess 32 of the closing element 26.

The electromagnetic actuator 40 serves to actuate the locking slider 42. It has in a manner known per se a magnetic coil 48 and also an armature 50 which is movable by feeding current to the magnetic coil 48. The locking slider 42 is coupled for movement with the armature 50 so that, when current is fed to the magnetic coil 48, the locking slider 42 moves together with the armature 50. The electromagnetic actuator 40 is electrically controlled by an electrical control unit, not shown in greater detail in the drawings, of the washing machine 10. In particular, the control unit is so adapted that a current feed pulse is not applied to the electromagnetic actuator 40 until the door switch 28 has signalled that the lid 18 is closed.

The auxiliary member 44, like the locking slider 42, is in the form of a linear slider, wherein in the example shown it is displaceable parallel to the locking slider 42. The auxiliary slider 44 has a slider head 52 which protrudes into the entry path followed by the closing element 26 as it enters the insertion opening 30. Consequently, on closing of the lid 18, not only is the door switch 38 (magnetically) actuated by the closing element 26—when it enters the insertion opening 30—but the auxiliary slider 44 is also urged by the closing element 26, by physical contact, out of the position shown in FIGS. 3*a*, 3*b* against the force of a return spring 54. If the lid 18 is opened again and the closing element moved out of the insertion opening 30, the return spring 54 pushes the auxiliary slider 44 back into the position according to FIGS. 3*a*, 3*b* again. This position forms a blocking position, because the auxiliary slider 44 in the blocking position prevents a movement of the locking slider 42 out of the unlocking position shown in FIGS. 3*a*, 3*b* into a locking position in which the locking tip 46 is advanced and engages into the recess 32 of the closing element 26. The urged-back position of the auxiliary slider 44, in which it is urged back by the closing element 26 against the force of the return spring 54, on the other hand, forms a release position because, in the release position, the locking prevention function, that is to say the function of the auxiliary slider 44 of preventing a locking movement of the locking slider 42, is deactivated. In the release position of the auxiliary slider 44, the locking slider 42 is released for displacement from the unlocking position according to FIGS. 3*a*, 3*b* into the locking position.

Figure 4A:
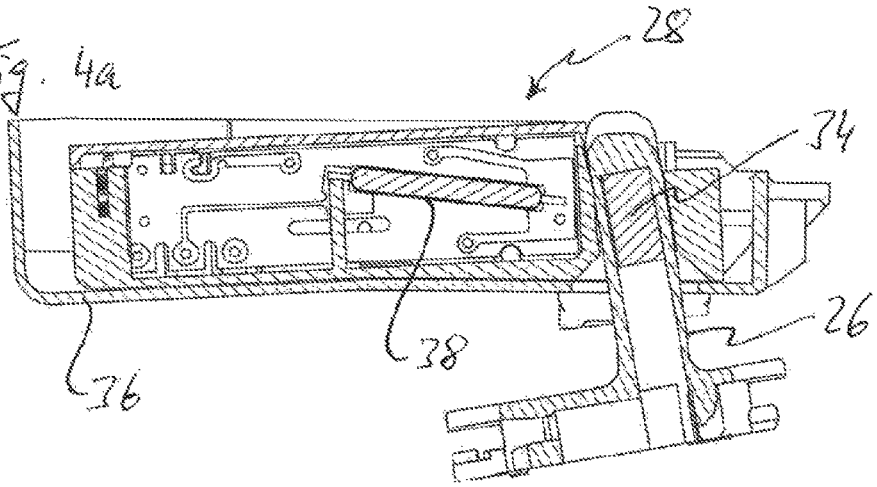
FIG. 4*a* is a section through the lock assembly of FIGS. 3*a*, 3*b* on entry of the closing element of FIG. 2 into an insertion opening of the lock assembly.
Figure 4B:
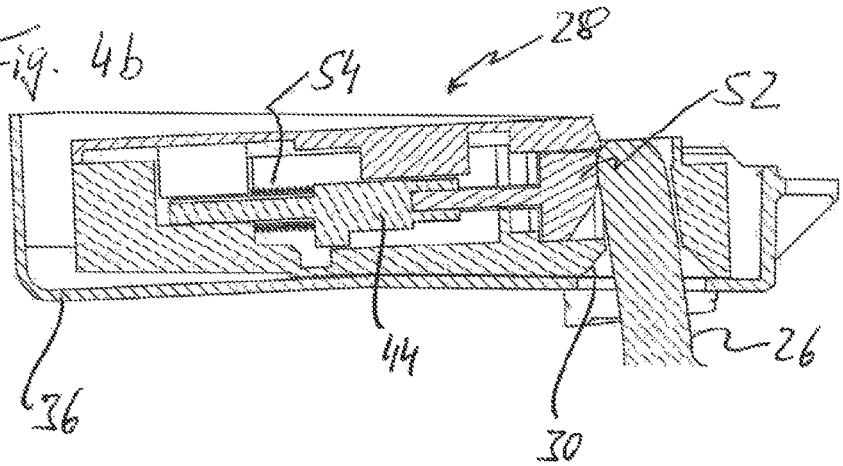
FIG. 4*b* is another section through the lock assembly of FIGS. 3*a*, 3*b* in the same situation as in FIG. 4*a*.

FIGS. 4*a*, 4*b* illustrate the situation after the closing element 26 has entered the insertion opening 30 of the lock assembly 28. The spatial proximity of the magnet 34 of the closing element 26 to the door switch 38 can clearly be seen in FIG. 4*a*. In FIG. 4*b*, the urged-back state of the auxiliary slider 44 (urged back from the closing element 26 against the force of the return spring 54) can clearly be seen. This is the mentioned release position of the auxiliary slider 44.

In order, when the lid 18 is open, to bring about the transfer of the locking slider 42 from the unlocking position into the locking position (and thus create the requirements for the possible start of a wash program) by intentional or unintentional manipulation of the lock assembly 28, it is not sufficient merely to effect closing of the door switch 38, for example by means of a hand-held magnet. The auxiliary slider 44 must additionally be urged back out of the blocking position according to FIGS. 3*a*, 3*b* into the release position according to FIG. 4*b* (e.g. by means of the finger of a hand or by means of a suitable tool). Both measures together are complicated even in the case of intentional manipulation, so that a high degree of protection against manipulation is provided in the exemplary embodiment shown.

In the example shown, the electromagnetic actuator 40 is fed with current in a pulsed manner in order to bring about a position change of the locking slider 42 (provided that the auxiliary slider 44 is in its release position). Each current feed pulse for the magnetic coil 48 leads to the armature 50 briefly being pulled into the magnetic coil 48, namely against the force of a resetting armature spring 56. The position of the armature 50 (and with it the position of the locking slider 42) is controlled by a guide system in the form of a sliding block guide, which comprises a guide track 58 and a track follower 60 guided on the guide track 58. The guide track 58 (which can also be referred to as a sliding track) extends in the form of an endless loop about a central guide island 62, see in particular FIGS. 5*a*, 5*b*. The guide track 58 defines multiple non-transitory track positions for the track follower 60. A first non-transitory track position is realised by an indentation 64 of the guide island 62; when the track follower 60 engages in the indentation 64 (as in FIG. 5*a*), it remains in the indentation 64 as long as the magnetic coil 48 does not receive a new current pulse. Therefore, the track position of the guide track 58 located at the indentation 64 is a non-transitory track position for the track follower 60.

A second non-transitory track position is located on the side remote from the indentation 64 on the opposite side of the guide island 62. In order to reach this second non-transitory track position, the track follower 60 must be moved out of the indentation 64 by excitation of the magnetic coil 48 and move around the guide island 62. FIG. 6*c* shows the track follower 60 in the second non-transitory track position. The track follower 60 also remains in this track position until the magnetic coil 48 receives a new current feed pulse, by which the track follower 60 is again guided around the guide island 62 and brought into the indentation 64.

In the exemplary embodiment shown, the track follower 60 is coupled for movement with the locking slider 42, while the guide track 58 is arranged stationarily relative to the magnetic coil 48. It will be appreciated that the guide track 58 can alternatively be formed on the locking slider 42 and the track follower 60 can instead be fixed to a component of the lock assembly 28 that is stationary relative to the magnetic coil 48.

In the exemplary embodiment shown, the track follower 60 is formed by a piece of wire whose opposite ends are bent in opposite directions; one of the bent end portions engages into the guide track 58, the other of the bent end portions engages into a receiving hole of the locking slider 42.

Figure 5A:
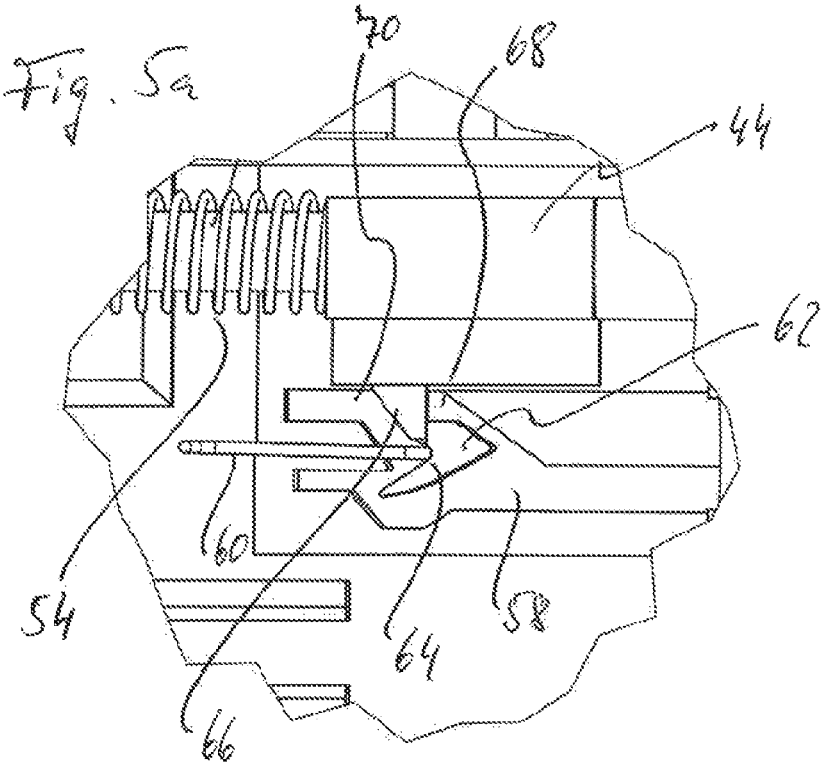
FIGS. 5*a* and 5*b* are views which illustrate a locking prevention function of the lock assembly of FIGS. 3*a*, 3*b*.
Figure 6A:
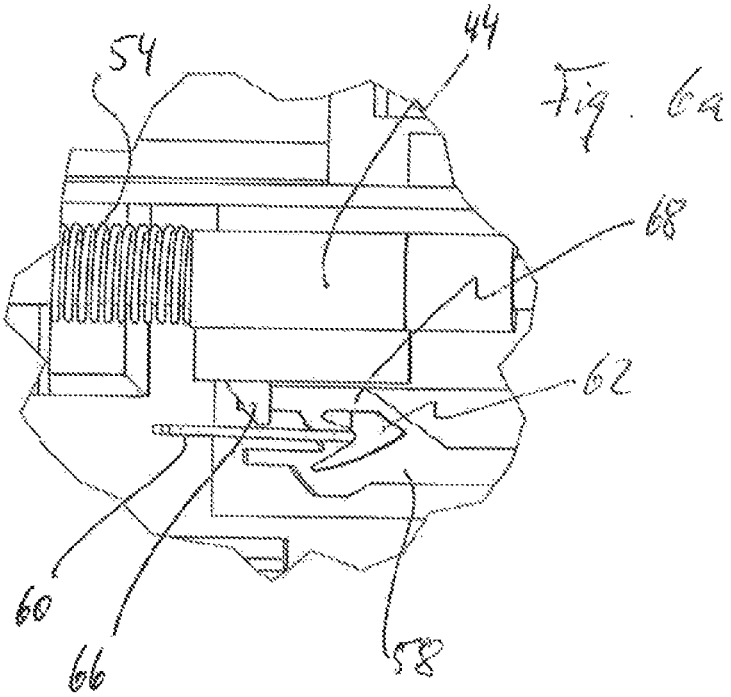
FIGS. 6*a*, 6*b* and 6*c* are views which illustrate a locking operation of the lock assembly of FIGS. 3*a*, 3*b* with the locking prevention function deactivated.
Figure 6B:
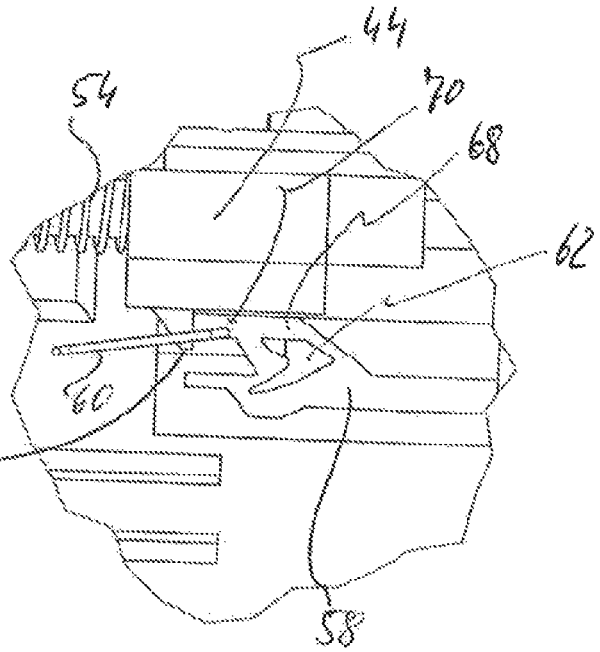
Figure 6C:
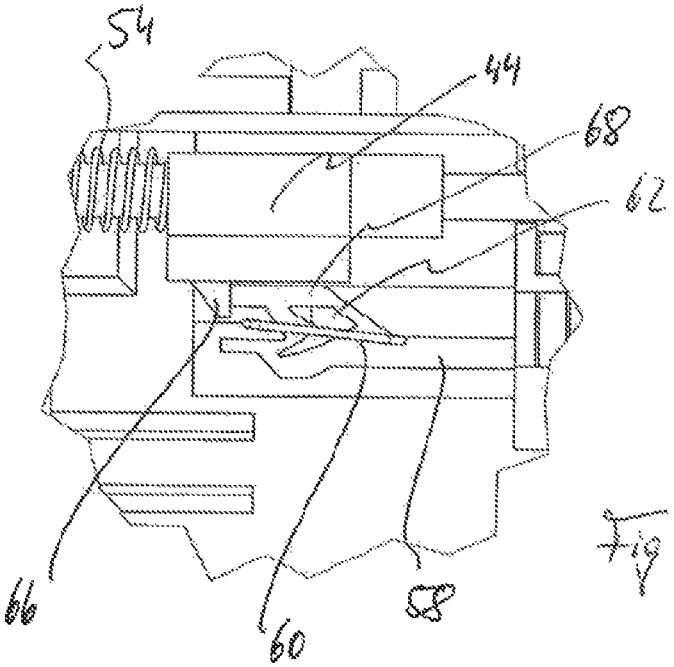

Successive current feed pulses for the magnetic coil 48 lead to the track follower 60 changing back and forth between the first non-transitory track position corresponding to FIG. 6*a* and the second non-transitory track position corresponding to FIG. 6*c*, provided that the auxiliary slider 44 is in its release position. In the example shown, in which the track follower 60 is coupled for movement with the locking slider 42, the first non-transitory track position according to FIGS. 5*a*, 6*a* corresponds to the unlocking position of the locking slider 42 (according to FIGS. 3*a*, 3*b*), whereas the second non-transitory track position according to FIG. 6*c* corresponds to the locking position of the locking slider 42, in which the locking tip 46 of the locking slider 42 is advanced into the region of the insertion opening 30 in order to engage into the recess 32 of the closing element 26.

As long as the auxiliary slider 44 is in its blocking position according to FIGS. 3*a*, 3*b*, activation of the locking slider 46, that is to say movement of the locking slider 46 into the locking position, is—as explained—not possible. The locking slider 42 is blocked against such movement by the auxiliary slider 44 as long as the auxiliary slider 44 is in its blocking position. In the exemplary embodiment according to FIGS. 5*a* to 6*c*, the auxiliary slider 44 has a blocking structure in the form of blocking projection 66, with which the auxiliary slider 44—as long as it is in its blocking position—extends into the movement path of the track follower 60 along the guide track 58. More specifically, the auxiliary slider 44 blocks with the blocking projection 66 one of the two passages which run past the sides of the guide island 62. The blocked side passage is designated 68 in FIGS. 5*a*, 5*b*.

Figure 5B:
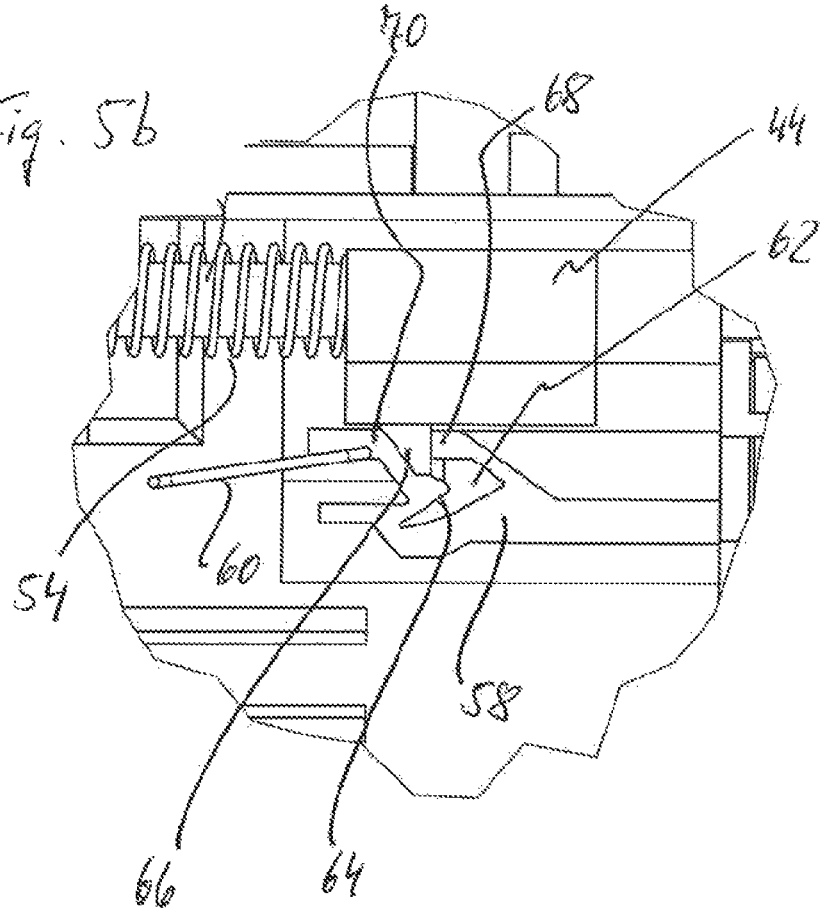

In order to move out of the first non-transitory position according to FIG. 5*a* into the second non-transitory position according to FIG. 6*c* by the feeding of current to the magnetic coil 48, the side passage 68 must be open for the track follower 60. However, because the side passage 68 is blocked by the blocking projection 66 in the blocking position of the auxiliary slider 44, the track follower 60 cannot enter the side passage 68. Instead, the blocking projection 66 is so configured that, when the magnetic coil 48 is excited, the track follower 60 merely enters a branch of the guide track 58 which, when the excitation is ended, ensures or makes it possible that the track follower 60 falls back into the first non-transitory position. This situation is shown in FIG. 5*b*. The track follower 60 has there entered a branch 70 of the guide track 58 (by excitation of the magnetic coil 48), from which it falls back into the indentation 64 under the restoring action of the armature spring 56 when the current feed to the magnetic coil 48 is ended; the blocking projection 66 prevents the track follower 60 from moving out of the track branch 70 into the side passage 68.

Therefore, in the blocking position of the auxiliary slider 44, successive actuations of the electromagnetic actuator 40 do not lead to the locking slider 42 changing into the locking position; the locking slider 42 remains in its unlocking position according to FIGS. 3*a*, 3*b*.

As soon as the auxiliary slider 44 has been urged by the closing element 26 into its release position according to FIG. 4*b*, the track follower 60 can pass unhindered around the guide island 62 on successive actuations of the electromagnetic actuator 40 and thereby change back and forth between the first non-transitory track position and the second non-transitory track position. This situation is shown in FIGS. 6*a* to 6*c*. As a result of the displacement of the auxiliary slider 44 into the release position, the blocking projection 66 has freed the side passage 68. If, starting from the first non-transitory track position of the track follower 60 according to FIG. 6*a* (corresponding to the unlocking position of the locking slider 42), current is fed in pulses to the magnetic coil 48, the track follower 60—as in FIG. 5*b*—moves into the track branch 70 of the guide track 58, as shown in FIG. 6*b*. Unlike in FIG. 5*b*, however, the blocking projection 66 no longer blocks the side passage 68, so that, when the current feed to the magnetic coil 48 has ended, the track follower is able to move out of the track branch 70 into the side passage 68 and, from there, into the second non-transitory track position according to FIG. 6*c* (corresponding to the locking position of the locking slider 42).

In the further figures, components that are the same or have the same action are provided with the same reference numerals as in the preceding figures, but with the addition of a lowercase letter. Unless indicated otherwise hereinbelow, reference is made to the preceding explanations to explain such components that are the same or have the same action.

Figure 7:
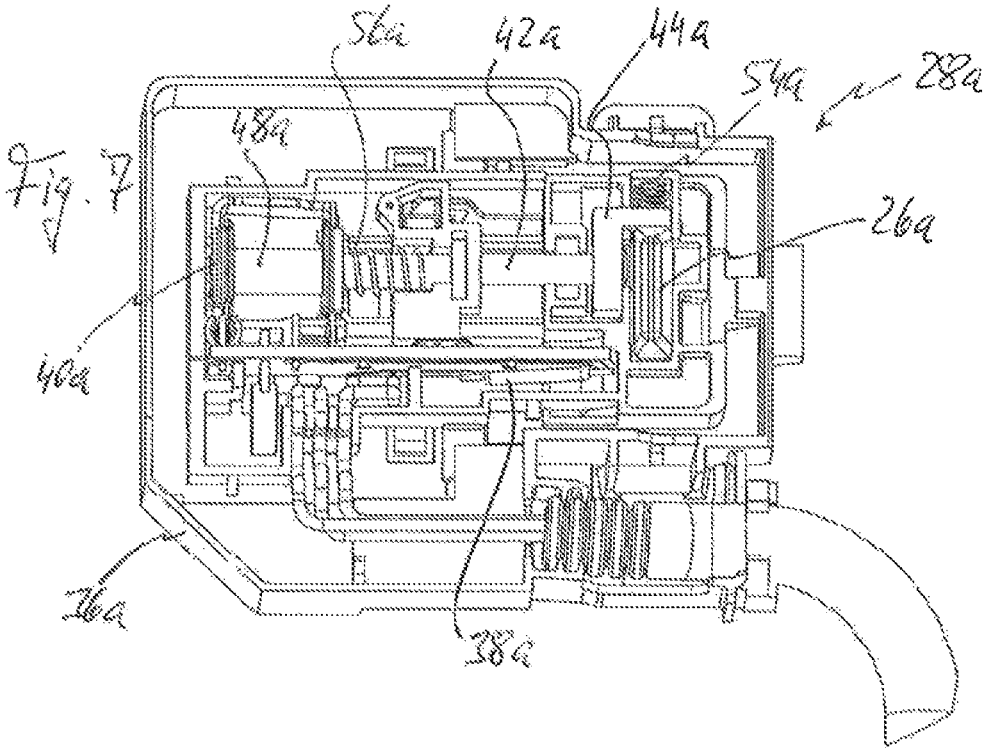
FIG. 7 is a perspective view of a door lock according to a further exemplary embodiment.

In the exemplary embodiment of FIG. 7, the sliding direction of the auxiliary slider 44*a* is not parallel to that of the locking slider 42*a*. Instead, the auxiliary slider 44*a* is displaceable in a direction perpendicular to the sliding direction of the locking slider 42 and substantially perpendicular to the insertion direction of the closing element 26*a* into the lock assembly 28*a*. In the view of FIG. 7, the auxiliary slider 44*a* has approximately an L-shape, wherein one of the legs of the L cooperates with the locking slider 42*a* and the other of the legs of the L cooperates with the closing element 26*a*. In the view of FIG. 7, when the closing element 26*a* enters the lock assembly 28*a*, the auxiliary slider 44*a* is pushed upwards by the closing element 26*a* (against the force of the return spring 54*a*) and thereby moves out of its blocking position into the release position.

Figure 8A:
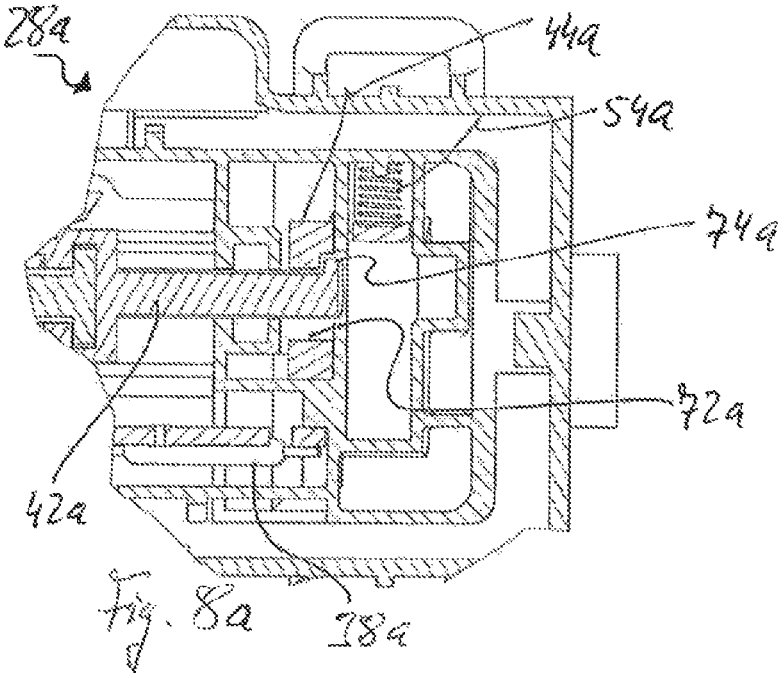
FIG. 8*a* is a sectional view of the door lock of FIG. 7 with the locking prevention function activated.

FIG. 8*a* shows the auxiliary slider 44*a* in its blocking position; the locking slider 42*a* extends through a through-hole 72*a* in the auxiliary slider 44*a* and engages with an end projection 74*a* behind the auxiliary slider 44*a*. Because of the engagement of the end projection 74*a* of the locking slider 42*a* behind the auxiliary slider 44*a*, the locking slider 42*a* is blocked against moving to the left in FIG. 8*a*. The locking slider 42*a* would seek to perform such a movement when current is fed to the electromagnetic actuator 40*a*. Therefore, in the blocking position of the auxiliary slider 44*a*, the locking slider 42*a* cannot be transferred from its unlocking position into the locking position.

Figure 8B:
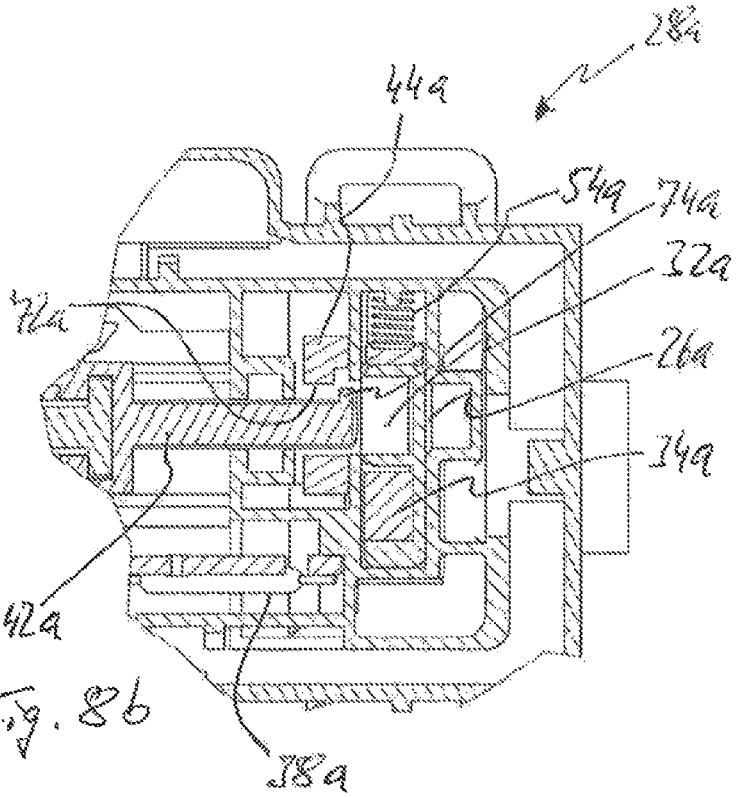
FIG. 8*b* is a sectional view of the door lock of FIG. 7 with the locking prevention function deactivated.

In the release position of the auxiliary slider 44*a*, as is shown in FIG. 8*b*, the end projection 74*a* of the locking slider 42*a* is out of engagement with the auxiliary slider 44*a*. The locking slider 42*a* is therefore not prevented from moving by the auxiliary slider 44*a*. By feeding current to the electromagnetic actuator 40*a*, the locking slider 42*a* can therefore be brought into its locking position, in which it engages into the recess 32*a* of the closing element 26*a*.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A door lock for a domestic electrical appliance, comprising a lock assembly and a closing element cooperating on closing of a door of the domestic appliance to hold the door closed, wherein the lock assembly comprises:

a locking member arranged for movement between an unlocking position and a locking position, which locking member in the unlocking position allows the closed door of the domestic appliance to be opened and in the locking position is directly in blocking engagement with the closing element when the door is closed, wherein the blocking engagement effects blocking of the closed door against opening;

an actuator actuatingly coupled to the locking member to move the locking member between the unlocking position and the locking position; and an auxiliary member, separate from the closing element, which is movable in dependence on the closing of the door from a blocking position into a release position and which in the release position allows the locking member to be transferred from the unlocking position into the locking position and in the blocking position blocks the locking member against being transferred from the unlocking position into the locking position.

2. The door lock according to claim 1, wherein the auxiliary member is controlled by the closing element which, on closing of the door, comes into physical control contact with the auxiliary member and urges the auxiliary member into the release position.

3. The door lock according to claim 2, further comprising an electrical switch controlled by the closing element, which electrical switch, on closing of the door, undergoes a change of switching status under the control of the closing element.

4. The door lock according to claim 3, wherein the electrical switch is magnetically actuatable and can be caused to change switching status on closing of the door by a magnet arranged on the closing element.

5. The door lock according to claim 1, wherein the actuator is an electromagnetic actuator and the door lock comprises a guide system for controlling the position of the locking member, wherein the guide system has an endless guide track which is closed to form a loop, and a track follower guided on the guide track, wherein, on successive actuations of the electromagnetic actuator, the track follower performs a complete circuit along the guide track and, on each circuit, moves out of a first non-transitory track position corresponding to the unlocking position of the locking member into a second non-transitory track position corresponding to the locking position of the locking member and back into the first non-transitory track position again.

6. The door lock according to claim 5, wherein the auxiliary member has a blocking structure which, in the blocking position of the auxiliary member, extends into the movement path of the track follower along the guide path in such a manner that the blocking structure prevents a change of the track follower from the first non-transitory track position into the second non-transitory track position, wherein the blocking structure, on transfer of the auxiliary member from the blocking position into the release position, moves out of the movement path of the track follower along the guide path in such a manner that a change of the track follower change from the first non-transitory track position into the second non-transitory track position is made possible.

7. The door lock according to claim 6, wherein the blocking structure, in the blocking position of the auxiliary member, extends into the movement path of the track follower along the guide track in such a manner that, on actuation of the electromagnetic actuator, the track follower remains within a track branch of the guide track adjoining the first non-transitory track position which, when actuation of the electromagnetic actuator is ended, ensures or makes it possible that the track follower falls back into the first non-transitory track position.

8. The door lock according to claim 5, wherein the auxiliary member in the blocking position extends into the movement path of the locking member in such a manner that the locking member is prevented from being transferred from the unlocking position into the locking position by abutment of the locking member on the auxiliary member.

9. The door lock according to claim 1, wherein the auxiliary member is linearly movable between the release position and the its blocking position.

10. The door lock according to claim 9, wherein the locking member is linearly movable parallel, in particular parallel in the same direction, or perpendicularly to the movement direction of the auxiliary member.

11. The door lock according to claim 1, wherein the auxiliary member is configured as a linear slider which is arranged for linear movement in a direction substantially perpendicular to an insertion direction of the closing element into the lock assembly.

12. A domestic electrical appliance, comprising:

an appliance main body having an access opening to a working chamber within the appliance main body; and a door attached to the appliance main body for closing the access opening;

a door lock comprising:

a lock assembly attached to one of the appliance main body and the door and having an insertion opening; and a closing element attached to the other of the appliance main body and the door, which closing element, on closing of the door, enters the insertion opening of the lock assembly, wherein the lock assembly comprises a locking member which can be electrically switched between an unlocking position and a locking position and which in the unlocking position allows the closed door to be opened and in the locking position is in blocking engagement with a blockable component of the door lock at least when the door is closed, wherein the blocking engagement effects blocking of the closed door against opening, wherein the lock assembly further comprises an actuator actuatingly coupled to the locking member to move the locking member linearly between the unlocking position and the locking position, wherein the lock assembly further comprises an auxiliary member, separate from the blockable component, which is movable in dependence on the closing of the door from a blocking position into a release position and which in the release position allows the locking member to be transferred from the unlocking position into the locking position and in the blocking position blocks the locking member against being transferred from the unlocking position into the locking position, wherein the locking member is linearly movable by the actuator in a direction that extends at least approximately perpendicularly to a direction in which the closing element enters the insertion opening on closing of the door.

* * * * *